US005913695A

United States Patent [19]

Okabe

[11] Patent Number: 5,913,695

[45] Date of Patent: Jun. 22, 1999

[54] CRIMPING TERMINAL

[75] Inventor: Toshiaki Okabe, Shizouka, Japan

[73] Assignee: Yazaki Corporation, Tokyo, Japan

[21] Appl. No.: 08/908,173

[22] Filed: Aug. 7, 1997

[30] Foreign Application Priority Data

Aug. 8, 1996 [JP] Japan ..... 8-210128

[51] Int. Cl.[6] ..... H01R 4/24

[52] U.S. Cl. ..... 439/397

[58] Field of Search ..... 439/397, 398, 439/399, 400, 406, 407, 877, 865, 867

[56] References Cited

U.S. PATENT DOCUMENTS

| | | | |
|---|---|---|---|
| 4,385,794 | 5/1983 | Lucius | 339/97 R |
| 4,940,425 | 7/1990 | Hass et al. | 439/397 |

FOREIGN PATENT DOCUMENTS

| | | |
|---|---|---|
| 1996081 | 11/1968 | Germany . |
| 4027773 | 3/1992 | Germany . |
| 4340377 | 6/1995 | Germany . |
| 4-15159 | 2/1992 | Japan . |
| 7-192777 | 7/1995 | Japan . |

*Primary Examiner*—Gary Paumen
*Assistant Examiner*—Antoine Ngandjui
*Attorney, Agent, or Firm*—Sughrue, Mion, Zinn, Macpeak & Seas, PLLC

[57] ABSTRACT

A crimping terminal is so designed that, by press-machining a piece of metal plate, an electrical contact section, and a wire cramping section are formed respectively at the front end portion and at the rear end portion, and a crimping conductive section is formed between the electrical contact section and the wire cramping section, the wire cramping section having a part of a bottom wall and right and left side walls which are bent inwardly to cramp a wire through the insulating sheath, the crimping having right and left crimping blades with a crimping slot between them. In the crimping terminal, the crimping conductive section is U-shaped in section, having right and left side walls, and a part of the bottom wall, the right side walls of the wire cramping section and the crimping conductive section are provided as one side wall, and the left side walls of the wire cramping section and the crimping conductive section are also provided as one side wall, and the right and left side walls of the crimping conductive section are partially cut and raised inwardly to form the right and left crimping blades.

30 Claims, 5 Drawing Sheets

FIG. 1 (a) PRIOR ART
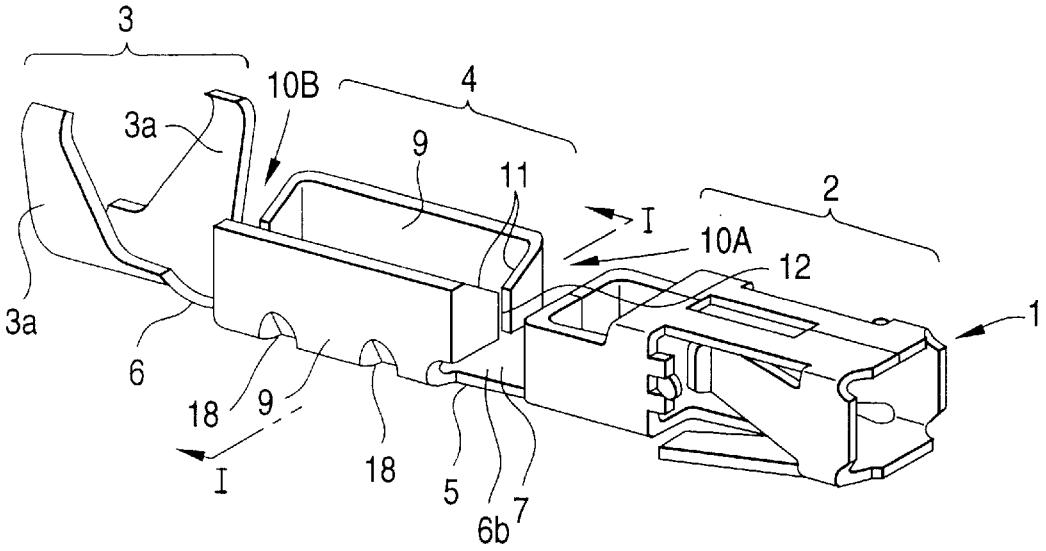
FIG. 1 (b) PRIOR ART
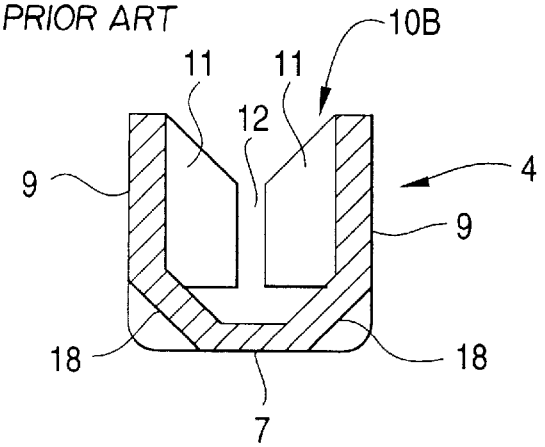
FIG. 1 (c) PRIOR ART
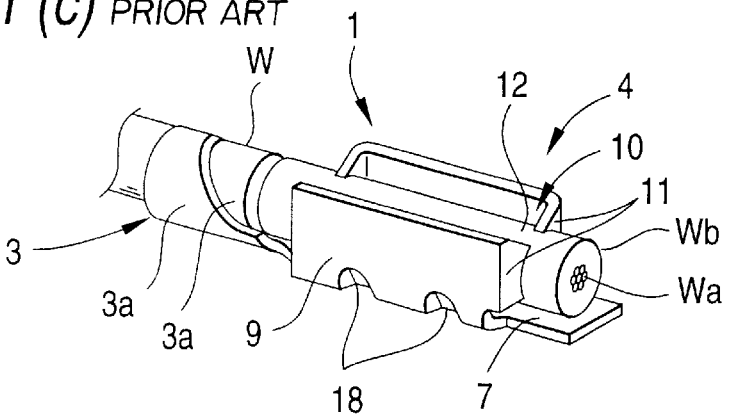

FIG. 2 (a) PRIOR ART
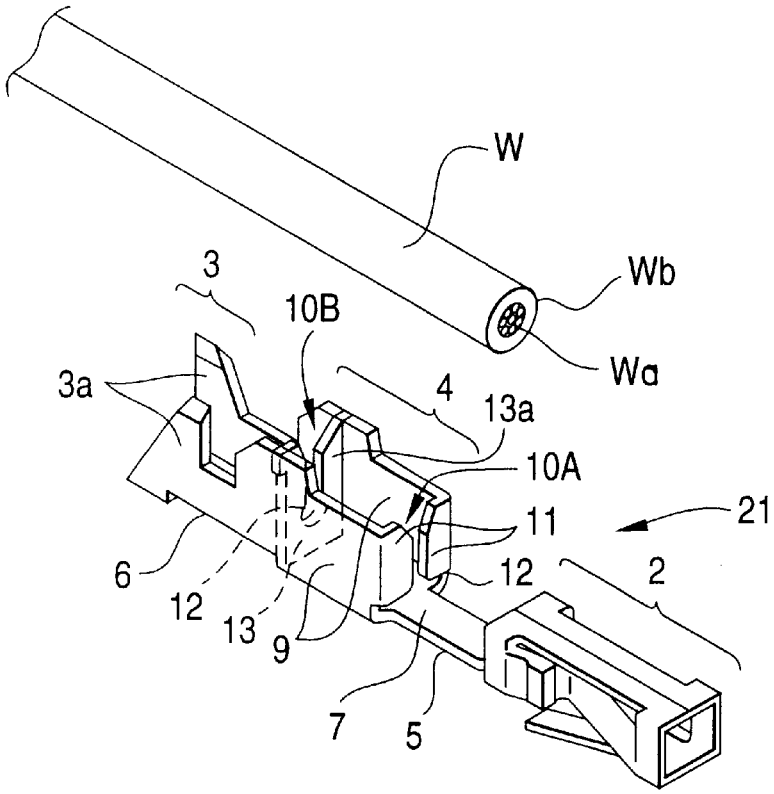
FIG. 2 (b) PRIOR ART
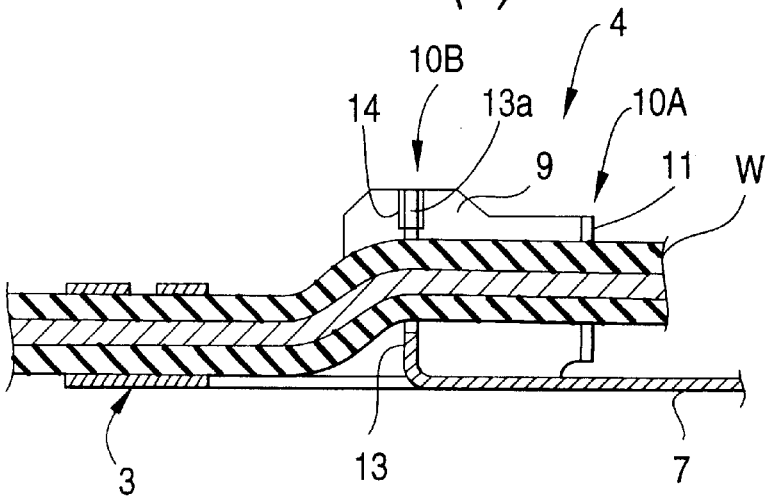

CRIMPING TERMINAL

BACKGROUND OF THE INVENTION

This invention relates to a crimping terminal which is so designed that, when a sheathed wire is pushed in a crimping slot, the conductor (core) of the wire is brought into contact with the crimping terminal without removal of the insulating sheath of the wire.

FIGS. 1(*a*)–1(*c*) show a conventional crimping terminal disclosed by U.S. Pat. No. 4,385,794. More specifically, FIG. 1(*a*) is a perspective view of the crimping terminal, FIG. 1(*b*) is a sectional view taken along line B—B of FIG. 1(*a*), and the FIG. 1(*c*) is a perspective view showing part of a sheathed wire connected to the crimping terminal.

In FIG. 1, reference numeral designates 1 the aforementioned conventional crimping terminal. The crimping terminal 1 is formed by press-machining a piece of thin metal sheet. Its front end portion is an electrical contact section 2 which is engaged with the mating terminal (not shown), and its rear end portion is a wire cramping section 3, and the middle portion between those front and rear end portions is a crimping conductive portion 4. The electrical contact portion 2 is engaged with the mating terminal so that the electrical contact portion 2 is electrically connected with the mating terminal; the wire cramping section 3 has right and left retaining pieces (parts of the walls) 3*a*, which are bent inwardly to fixedly hold the wire W from above the insulating sheath Wb; and the crimping conductive section 4 is electrically connected to the conductor Wa of the wire W. The wire cramping section 3 is coupled through a first constricted portion 6*a* to the crimping conductive section 4, and the crimping conductive section 4 is coupled through a second constricted portion 6*b* to the electrical contact section 2.

The crimping conductive section 4 has a front crimping pieces 10A and a rear crimping piece 10B respectively at the front end and the rear end. Each of the front and rear crimping pieces 10A and 10B has a pair of right and left crimping blades which are confronted with each other, forming a crimping slot 12 in which the conductor of the wire is pushed. The wire cramping section 3, the crimping conductive section 4, and the electrical contact section 2 have a belt-shaped common bottom wall. The crimping conductive section 4 is U-shaped in section, having the bottom wall 7 and a pair of right and left side walls 9 which are formed by bending the right and left edge portions of the bottom wall 7 upwardly. The crimping blades 11 of the crimping pieces 10A and 10B are formed by inwardly bending the front and rear edge portion of the side walls 9. The crimping conductive section 4 has recesses 18 which are formed by pressing on the lines along which the side walls 9 are bent with respect to the bottom wall 7, so that the crimping conductive section is increased in bending rigidity.

The wire W is connected to the crimping terminal 1 as follows: One end portion of the wire W is laid on the rear end portion of the crimping terminal 1 in such a manner that the one end portion of the wire W is in parallel with the rear end portion of the crimping terminal 1. Under this condition the one end portion of the wire W is pushed in the crimping slots 12 of the crimping conductive section 4 from above. In this case, the right and left crimping blades 11 cut the insulating sheath Wb of the wire W, and contact the conductor Wa of the wire W. When the one end portion of the wire W is further pushed in, the conductor Wa is caused to go in between the right and left crimping blades 11, thus being positively held by the right and left crimping blades 11. In this operation, a force is applied to the right and left crimping blades 11 to open the same outwardly.

FIG. 2 shows a crimping terminal 21 which has been disclosed by Japanese Utility Model Unexamined Publication No. 15159/1992. The crimping terminal 21 is also formed by press-machining a piece of thin metal plate. The front end portion of the crimping terminal 21 is an electrical contact section 2 which is connected to the mating terminal, the rear end portion is a wire cramping section 3, and the middle potion between the front and rear end portions is a crimping conductive section 4. The wire cramping section 3 is coupled through a first constricted portion 6*a* to the crimping conductive section 4, and the crimping conductive section 4 is coupled through a second constricted portion 6*b* to the electrical contact section 2.

The crimping conductive section 4 is U-shaped in section, having a part of the bottom wall 7 which is extended to the electrical contact section 2 and the wire cramping section 3, and a pair of right and left side walls 9 which are formed by bending the right and left edge portions of the bottom wall 7 upwardly. The side walls 9 of the crimping conductive section 4 are continuous to the side walls of the wire cramping section 3, respectively. The crimping conductive section 4 has a front crimping pieces 10A and a rear crimping piece 10B respectively at the front end and at the rear end. Each of the front and rear crimping pieces 10A and 10B has a pair of right and left crimping blades 11 which are confronted with each other, forming a crimping slot 12 in which the conductor of the wire is pushed. The crimping blades 11 are formed by inwardly bending the front edge portions of the side walls 9. The rear contact piece 10B is formed with a crimping plate 13 which is obtained by cutting and raising the bottom wall 7 of the second constricted portion 6*b*. The crimping plate 13 comprises right and left crimping blades 13*a*, and a crimping slot 12 defined by the right and left crimping blades 13*a*. The right and left upper end portions of the crimping plate 13 are engaged with slots 14 formed in the side walls 9, which prevents the crimping plate from falling down forwardly or backwardly.

In general, a crimping terminal is mass-produced, and a number of crimping terminals are built in a connector housing in such a manner that they are adjacent to one another. Hence, there has been a strong demand for the provision of a crimping terminal which is small in size, and light in weight. In order to decrease the weight of the crimping terminal, it is essential to reduce the thickness of a metal plate which is formed into the crimping terminal. In addition, in order to miniaturize the crimping terminal, it is necessary to decrease the width and the length of the crimping terminal. For instance, in order to decrease the width of the crimping terminal, it is essential to decrease the width of the crimping blades forming the crimping slot.

However, if the thickness of the metal plate, which is used to form the crimping terminal, is decreased, or if the width of the crimping blades is decreased, then the mechanical strength of the crimping blades is decreased, as a result of which, when the wire is pushed in the crimping slot, the right and left crimping blades are opened outwardly.

In view of the foregoing, in the conventional crimping terminal 1 shown in FIG. 1, the crimping blades 11 are formed by bending inwardly the front and rear edge portions of the side walls 9 of the crimping conductive section 4. However, the force which acts on the crimping blades 11 when the wire is pushed in the crimping slots, acts collectively on the junctions (the bent portions) of the side walls and the bottom wall 7. As a result, the side walls 9 are bent outwardly, and accordingly, the crimping blades 11 are bent outwardly (opened). In order to overcome this difficulty, the recesses are formed on the junctions of the side walls 9 and the bottom wall 7; however, the recesses are not so effective in preventing the upper end portions of the side walls 9 from falling down; that is, they are not so effective in preventing the crimping blades 11 from being opened.

In the case of the conventional crimping terminal 21 shown in FIG. 2, the side walls 9 of the crimping conductive section 4 are integrally formed with the side walls (the lower portions of the retaining pieces 3*a*) of the wire cramping section 3. This feature may prevent the side walls 9 from falling down (bending outwardly). However, since the crimping plate 13 which is obtained by cutting and raising the bottom wall 7 of the first constricted portion 6*a* is employed as the rear crimping piece 10B, it is necessary to obtain an additional dimension in the bottom wall 7 of the first constricted portion 6*a* which corresponds to the height of the crimping plate 13, and accordingly it becomes difficult to reduce the dimension between the crimping conductive section 4 and the wire cramping section 3, as a result of which the terminal is unavoidably bulky. Furthermore, the side walls 9 of the crimping conductive section 4 are separated from the crimping plate 13, and therefore the side plates 9 do not sufficiently support the crimping plate 13 laterally. Accordingly, it is impossible to prevent the crimping blades 13*a* from being opened outwardly.

SUMMARY OF THE INVENTION

Accordingly, it is an object of the invention to eliminate the above-described difficulties accompanying a conventional crimping terminal.

More specifically, an object of the invention is to provide a crimping terminal which is miniaturized, and in which, when the wire is pushed into a space between the crimping blades, the crimping blades are prevented from being opened outwardly; that is, to improve the reliability in electrical connection of the crimping terminal.

The foregoing object and other objects of the invention have been solved by the provision of a crimping terminal, according to a first aspect of the present invention, comprising:

an electrical contact section for engaging with a mating terminal;

a wire cramping section being U-shaped in section, having a bottom wall and a pair of right and left side walls which are to be bent inwardly to fixedly hold a wire from above an insulating sheath of the wire; and a crimping conductive section disposed between the electrical contact section and the wire cramping section for electrically connecting to a conductor of the wire, the crimping conductive section being U-shaped in section, having a bottom wall, a right side wall having a right crimping blade member and a left side wall having a left crimping blade member so as to define a crimping slot between the right and left crimping blade members, wherein the right side walls of the wire cramping section and the crimping conductive section are integrally provided as one side wall, and the left side walls of the wire cramping section and the crimping conductive section are integrally provided as one side wall, and wherein a portion of each the right and left side walls of the crimping conductive section is partially cut and raised inwardly so as to form the right and left crimping blade members.

In the crimping terminal of first aspect of the present invention, the side walls of the crimping conductive section are continuous to the side walls of the wire cramping section, and therefore the side walls of the crimping conductive section are restricted by the side walls of the wire cramping section. Hence, when the wire is pushed in the crimping slots of the crimping conductive section, the right and left crimping blade members may tend to open outwardly; however, the opening of the crimping blade members is restricted since the side walls having the crimping blade members are restricted as described above. In the case where the wire is cramped, and at the same time the wire is pushed in the crimping slots, the side walls of the wire cramping section are bent inwardly when the wire is cramped. Therefore, even if the crimping blade members of the crimping conductive section tend to open outwardly as the wire is pushed in the crimping slots, the crimping blade members are prevented from being opened outwardly, because the inward force acting on the side walls of the wire cramping section and the outward force acting on the side walls from the crimping blade members of the crimping conductive section are canceled out by each other.

In the above-mentioned crimping terminal, as a second aspect of the present invention, a first coupling section for coupling the crimping conductive section to the wire cramping section may be further provided, the first coupling section being U-shaped in section, having a bottom wall, a right side wall and a left side wall, wherein the bottom wall, the right side wall and the left side walls of the crimping conductive section are coupled to the bottom wall, the right side wall and the left side wall of the wire cramping section through the bottom wall, the right side wall and the left side wall of the first coupling section, respectively.

In the crimping terminal of the second aspect of the present invention, as described above, the bottom wall, and the right and left walls of the crimping conductive section are coupled to the bottom wall, and the right and left walls of the wire cramping section through the bottom wall and the right and left wall of the first coupling section. Hence, the wire cramping section and the crimping conductive section are high in mechanical strength.

In the above-mentioned crimping terminal, as a third aspect of the present invention, the electrical contact section may be made in the form of a box, having a right side wall, a left side wall, a top wall, and a bottom wall, and the right side walls of the electrical contact section and the crimping conductive section are integrally provided as one side wall, and the left side walls of the electrical contact section and the crimping conductive section are integrally provided as one side wall.

In the crimping terminal of the third aspect of the present invention, as described above, the right side walls of the electrical contact section and the crimping conductive section are provided as one side wall, and the left side walls of the electrical contact section and the crimping conductive section are provided as one side wall. Therefore, the side walls of the crimping conductive section are restricted by the side walls of the electrical contact section and by the side walls of the wire cramping section. Accordingly, when the wire is pushed in the crimping slots of the crimping conductive section, the right and left crimping blade members are scarcely opened outwardly, because the side walls having the crimping blade members are restricted in movement as described above.

In the above-mentioned crimping terminal, as a fourth aspect of the present invention, a second coupling section for coupling the electrical contact section to the wire crimping section may be further provided, the second coupling section being U-shaped in section, having a bottom wall, a right side wall and a left side wall, wherein the bottom wall, the right side wall and the left side wall of the crimping conductive section are coupled to the bottom wall, the right side wall and the left side wall of the electrical contact section through the bottom wall, the right side wall and the left side wall of the second coupling section, respectively.

In the crimping terminal of the fourth aspect of the present invention, in the wire cramping section, the crimping conductive section, and the electrical contact section, their bottom walls are provided as one wall, and their right side walls are provided as one wall, and their left side walls are also provided as one wall. Hence, the crimping terminal is high in rigidity as a whole.

In the above-mentioned crimping terminal, as a fifth aspect of the present invention, each of the right and left crimping blade members may comprise a front and rear crimping blades so as to define a front crimping slot and a rear crimping slot between the right and left crimping blade members;

the upper end portions of the front and rear crimping blades of the right crimping blade members may be coupled through a right coupling wall; and the upper end portions of the front and rear crimping blades of the left crimping blade members may be coupled through a left coupling wall.

In the crimping terminal of the fifth aspect of the present invention, as described above, the upper end portions of the front and rear crimping portions are coupled through a coupling wall.

That is, the right crimping blades are provided as one unit, and the left crimping blades are also provided as one unit, which positively prevents the crimping blades of the front and rear crimping portions from opening outwardly.

In the above-mentioned crimping terminal, as a sixth aspect of the present invention, the right coupling wall may be formed by a part of the right side walls of the crimping conductive section, and the left coupling wall may be formed by a part of the left side walls of the crimping conductive section.

In the crimping terminal of the sixth aspect of the present invention, as described above, the coupling walls are parts of the side walls of the crimping conductive section. Therefore, the effect of the side wall which prevents the crimping blade members from opening outwardly, is applied to the crimping blades of the two crimping portions.

In the crimping terminal, as a seventh aspect of the present invention, the front and rear crimping blades of the right crimping blade members may be respectively made by bending protrusions extended from front and rear edges of a first opening formed on the right side wall of the crimping conductive section, and the right coupling wall may be made by a wall-like portion remaining above the first opening; and the front and rear crimping blades of the left crimping blade members may be respectively made by bending protrusions extended from front and rear edges of a first opening formed on the left side wall of the crimping conductive section, and the left coupling wall may be made by a wall-like portion remaining above the first opening.

In the crimping terminal of the seventh aspect of the present invention, the first openings are formed in the right and left side walls of the crimping conductive section, respectively, and the protrusions extended from the front and rear edges of each of the first openings are bent inwardly to readily form the crimping blades whose upper end portions are coupled to each other through the coupling wall.

In the crimping terminal, as a eight aspect of the present invention, the right and left side walls of the crimping conductive section may have second openings in such a manner that the second openings are respectively in alignment with the first openings in a front-to-rear direction, and protrusions extended from the front or rear edges of the second openings may be bent inwardly to form a pair of crimping blades between which a third crimping slot is defined.

In the crimping terminal of the eighth aspect of the present invention, owing to the formation of the first and second openings, at least three crimping portions are arranged in the front-to-rear direction. In addition, all the crimping portions are made continuous to one another by the side walls. This feature prevents the crimping blades of the crimping portions from opening outwardly.

The nature, utility and principle of the invention will be more clearly understood from the following detailed description and the appended claims when read in conjunction with the accompanying drawings.

BRIEF DESCRIPTION OF THE DRAWINGS

In the accompanying drawings:

FIG. 1(*a*) is a perspective view of an example of a conventional crimping terminal, FIG. 1(*b*) is a sectional view taken in the direction of the arrows substantially along line B—B in FIG. 1(*a*), and FIG. 1(*c*) is a perspective view showing part of the conventional crimping terminal which is connected to a wire;

FIG. 2(*a*) is a perspective view of another example of the conventional crimping terminal, and FIG. 2(*b*) is a sectional view showing parts of the conventional crimping terminal which is connected to a wire;

DETAILED DESCRIPTION OF THE INVENTION

Preferred embodiments of the invention will be described with reference to the accompanying drawings.

An example of a crimping terminal, which constitutes a first embodiment of the invention, will be described with reference to FIGS. 3 and 4.

Figure 3:
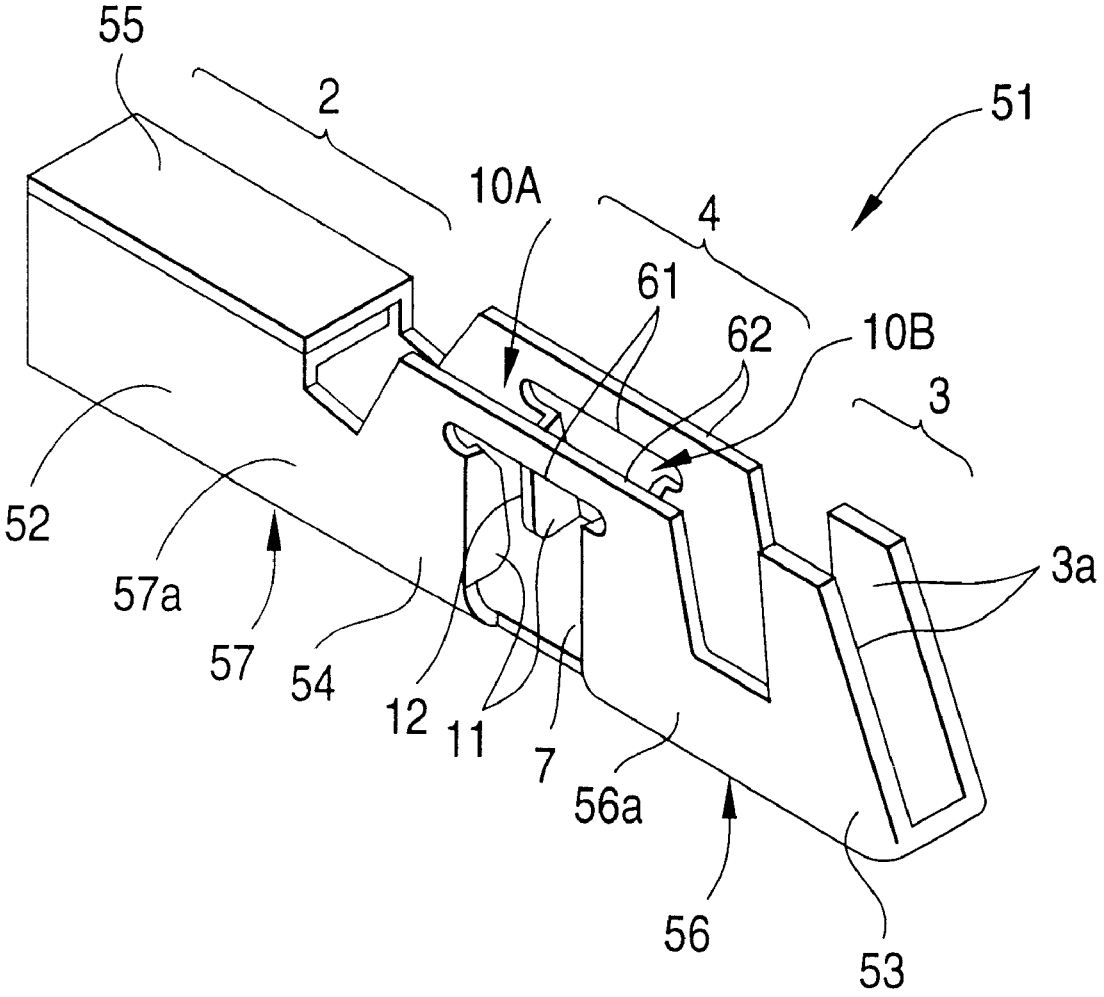
FIG. 3 is a perspective view showing an example of a crimping terminal, which constitutes a first embodiment of the invention.
Figure 4:
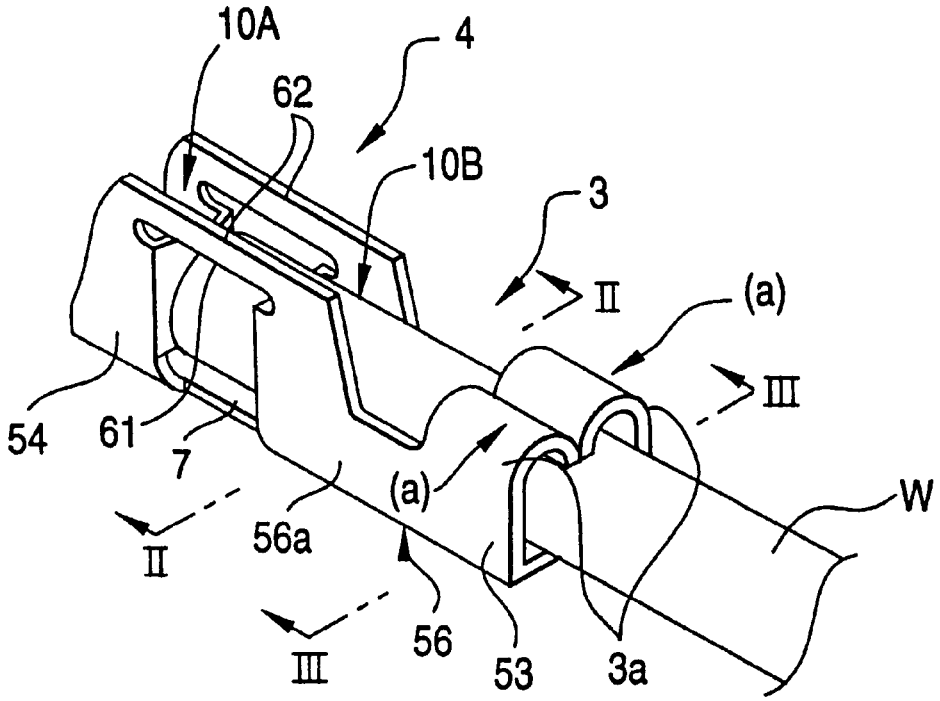
FIG. 4(*a*) is a perspective view showing part of the crimping terminal which is connected to a wire, FIG. 4(*b*) is a sectional view taken along line B—B in FIG. 4(*a*), and FIG. 4(*c*) is also sectional view taken along line C—C in FIG. 4(*a*)
Figure 4:
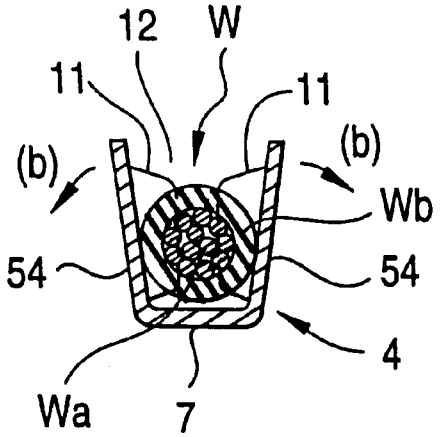
Figure 4:
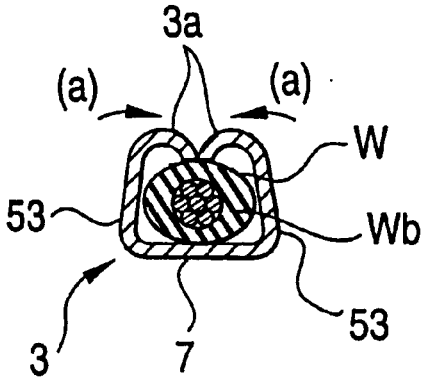

In FIGS. 3 and 4, reference numeral 51 designates the crimping terminal of the first embodiment. The crimping terminal 51 is obtained by press-machining a piece of thin metal terminal. The front end portion of the crimping terminal 51 is an electrical contact section 2 which is engaged with a mating terminal (not shown), and the rear end portion is a wire cramping section 3, and the middle portion between the front and rear end portions is a crimping conductive section 4.

The electrical contact section 2 is engaged with the mating terminal to electrically connect the wire W to the mating terminal. The electrical contact section 2 is in the form of a box, defined by right and left side walls 52, a top wall 55, and a part of a bottom wall. The wire cramping section 3 is to hold the wire W through the insulating sheath Wb. The wire cramping section 3 is U-shaped in section, defined by a part of the bottom wall 7, and right and left side walls 53. The upper end portions of the right and left side walls 53 are retaining pieces 3*a* which are bent inwardly over the wire W thereby to hold the wire W. The crimping conductive section 4 functions to electrically connect itself (the terminal) with the conductor Wa of the wire W, and it is U-shaped in section, defined by a part of the bottom wall 7, and right and left side walls 54. The wire cramping section 3 is coupled to the crimping conductive section 4 through a first coupling section 56. The first coupling section 56 is U-shaped in section, having a part of the bottom wall 7, and right and left side walls 56*a*. The crimping conductive section 4 is coupled to the wire cramping section 2 through a second coupling section 57. The second coupling section 57 is U-shaped in section, defined by the bottom wall 7 and the right and left side walls 57*a*.

As is apparent from the above description, the wire cramping section 2, the crimping conductive section 4, and the electrical contact section 3 have a single common bottom wall 7. The right side walls 53, 56*a*, 54, 57*a* and 52 are provided as one flat wall, and similarly the left side walls 53, 56*a*, 54, 57*a* and 52 are also provided as one flat wall. That is, those right and left side walls 53, 56, 54, 57*a* and 52 are formed by upwardly bending the right and left wall plates which are extended from the right and left edges of the bottom wall 7.

The crimping conductive section 4 has a front crimping piece 10A and a rear crimping piece 10B respectively at the front and rear ends. Each of the crimping pieces 10A and 10B, comprises a pair of right and left crimping blades 11, which defines a crimping slot 12 into which the conductor of the wire W is push. The right and left walls 54 of the crimping conductive section 4 have two rectangular openings 61 (hereinafter referred to as "first openings 61", when applicable), respectively. Protrusions extended from the front and rear edges of each of the first openings 61 are bent inwardly to form the aforementioned crimping blades 11. Above each of the rectangular openings 61, the wall (which is a part of the side wall 54) remains as a coupling wall 62. That is, the upper end portions of the right crimping blades of the crimping pieces 10A and 10B are coupled to each other through the right-side coupling wall 62 respectively, and similarly, the upper end portions of the left crimping blades of the crimping pieces 10A and 10B are coupled to each other through the left-side coupling wall 62. In the crimping terminal of the invention, the rectangular openings 61 are formed in the side walls 54 of the crimping conductive section 4, and the protrusions extended from the front and rear edges of the openings 61 are formed into the crimping blades 11, so that the side walls 53, 56*a*, 54, 57*a* and 52 are continuous to one another, being provided as one side wall.

Now, the operation of the crimping terminal of the invention will be described with reference to FIGS. 3 and 4.

The wire W is connected to the crimping terminal of the invention as follows: As shown in FIG. 4(*a*), one end portion of the wire W is laid on the rear end portion of the crimping terminal 51 in such a manner that the one end portion of the wire W is positioned in parallel with the rear end portion of the crimping terminal 51. Under this condition, the wire is pushed in the crimping slots 12 (cf. FIG. 3) of the crimping conductive section 4 from above. As a result, as shown in FIG. 4(*b*), the right and left crimping blades cut the insulating sheath Wb of the wire W, and contact the conductor Wa from both sides. When the wire W is further pushed in, the conductor Wa is moved and positioned between the right and left crimping blades 11, and positively held by the crimping blades 11.

In this operation, forces are applied to the right and left crimping blades 11 as indicated by the arrows (b) in FIG. 4(*b*); however, the opening of the crimping blades 11 can be prevented for the following reason:

In the crimping terminal 51, the right side walls 52, 54 and 53 of the electric contact section 2, the crimping conductive section 4 and the wire cramping section 3 are provided as one continuous side wall; and the left side walls 52, 54 and 53 are also provided as one continuous side wall. In addition to this, the first coupling section 56 through which the crimping conducting section 4 is coupled to the wire cramping section 3, is formed into U-shape in section, defined by the bottom wall 7 and the right and left side walls 56*a*, and further the second coupling section 57 through which the crimping conducting section 4 is coupled to the electrical contact section 2 is also formed into U-shape in section, defined by the bottom wall 7 and the right and left side walls 57*a*. Hence, not only the crimping terminal 51 is increased in rigidity as a whole, but also the side walls 54 of the crimping conductive section 4 are greatly restricted by the side walls 52 and 54 of the electrical contact section 2 and the wire cramping section 3 which are located in the front and rear of the crimping conductive section 4. Especially, since the electrical contact section 2 is made in the form of a box, the restricting force of the side wall 52 relative to the side wall 54 is considerably great. As a result, even if a force is applied to open the crimping blades 11 of the crimping conductive section 4 outwardly, the side walls 54 forming the crimping blades 11 are restricted at the front and rear end; that is, the crimping blades 11 will never be opened outwardly.

The cramping (holding) of the wire W with the wire cramping section 3, and the pushing of the wire W in the crimping conductive section 4 may be carried out at the same time. In this case, as shown in FIG. 4(*c*), the retaining pieces 3*a* of the upper end portions of the side walls 53 of the wire cramping section 3 are bent inwardly as indicated by the arrows (a). Hence, even if, as shown in FIG. 4(*b*), the crimping blades 11 of the crimping conductive section 4 are caused to open outwardly as indicated by the arrows (b) as the wire is pushed in, the inward force acting on the side walls 53 of the wire cramping section 3 and the outward force acting on the side walls 54 from the crimping blades 11 of the crimping conductive section 4 are canceled out by each other. As a result, the crimping blades 11 are more effectively prevented from being opened outwardly.

As described above, since the crimping blades 11 are effectively prevented from being opened outwardly, so that ever if the widths of the crimping blades 11 is decreased to miniaturize the crimping terminal, the crimping terminal is free from the difficulty that the crimping blades 11 cut the insulating sheath Wb unsatisfactorily when the wire is pushed in the crimping slots. In addition, the contact load (or holding load) on the conductor Wa of the wire W can be high enough; that is, the electrical connection is improved in reliability.

In the crimping terminal according to the invention, the right and left crimping blades 11 of the crimping conductive section 4 are obtained by cutting and raising the right and left side walls 54. Hence, in the case of the crimping terminal of the invention, unlike the conventional one in which the crimping blades are obtained by cutting and raising the bottom wall 7 as shown in FIG. 2, it is unnecessary to prepare a dimension to cut and raise the crimping blades, and the longitudinal dimension of the crimping terminal can be decreased as much. Furthermore, in the crimping terminal, from the wire cramping section 3 up to the crimping conductive section 4, the right walls 53 and 54 are continuous, and the left walls 53 and 54 are also continuous, which prevents the center of the crimping conductive section 4 and the center of the wire cramping section 3 from shifting from each other. Accordingly, the crimping terminal of the invention is free from the difficulty that, the working efficiency is lowered by the fact that the wire W is bent when the wire W is pushed in the crimping slots or cramped.

The crimping terminal according to the invention is provided with the crimping pieces 10A and 10B respective at the front and rear ends, and the right crimping blades 11 are coupled through the coupling wall 62 to each other, and similarly the left crimping blades 11 are coupled through the coupling wall 62 to each other; in other words, the right crimping blades 11 are integral with each other, and the left crimping blades 11 are also integral with each other. Hence, the side walls 54 equally prevent the crimping blades 11 of the two crimping pieces 10A and 10B from falling aside.

Furthermore, the side walls 54 of the crimping conductive section has the rectangular openings 61, and the protrusions extended from the front and rear edges of the rectangular openings 61 are bent inwardly to form the crimping blades 11, the crimping blades 11, whose the upper end portions are coupled through the coupling walls 62 and whose strength for preventing from falling aside is high, can be easily obtained.

Now, another example of the crimping terminal, which constitutes a second embodiment of the invention, will be described.

Figure 5:
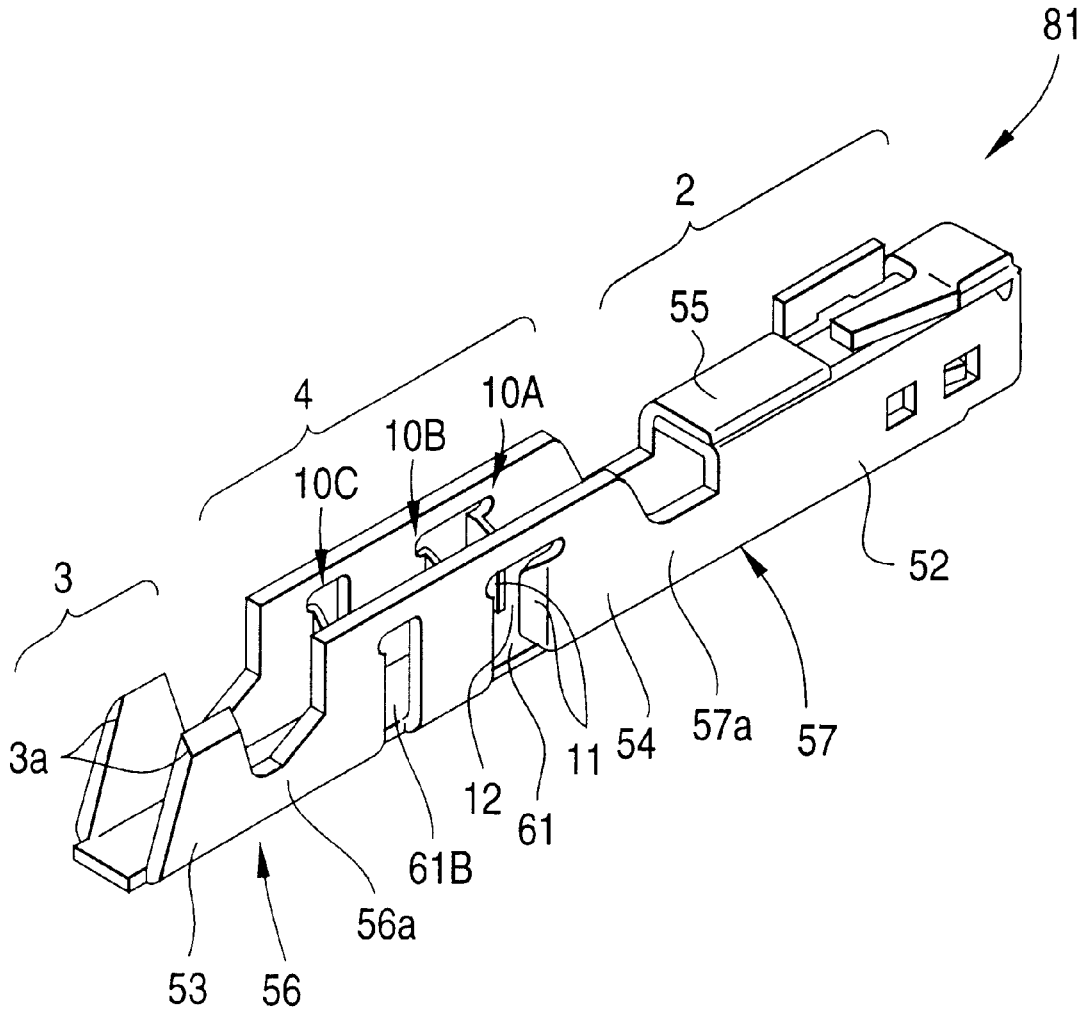
FIG. 5 is a perspective view showing another example of the crimping terminal, which constitutes a second embodiment of the invention.

In FIG. 5, reference numeral 81 designates the crimping terminal, the second embodiment of the invention. The crimping terminal 81 is substantially equal in structure to the crimping terminal 51, the first embodiment. That is, the crimping terminal 81 is different from the crimping terminal 51 only in the following points: The crimping conductive section 4 has, in addition to two crimping pieces 10A and 10B (hereinafter referred to as "first and second crimping pieces 10A and 10B), a third crimping piece 10C at the rear end portion. The right and left side walls 54 of the crimping conductive section 4 have the openings 61 (hereinafter referred to as "first openings 61), and second openings 61B behind the first openings. Protrusions extended from the rear edges of the second openings 61B are bent inwardly, to form the crimping blades 11 and the crimping slot 12 of the third crimping piece 10C. The other arrangements are equal to those of the above-described first embodiment. In FIG. 5, parts corresponding functionally to those already described with reference to FIGS. 3 and 4 (the first embodiment) are therefore designated by the same reference numerals or characters.

In the second embodiment, the first and second openings 61 and 61B provide the first, second and third crimping pieces 10A, 10B and 10C. Hence, the wire is more positively held with the crimping terminal, and the electrical connection is improved in reliability.

The second opening 61B may be located in front of the first openings 61. In the second embodiment, the crimping piece is formed by using the front edges of the second openings 61; however, it may be formed by using the rear edges thereof. Furthermore, third and fourth crimping pieces may be formed by using the front and rear edges of the second openings 61B. The number of crimping pieces should be at least one, and the number of openings should be determined according to the number of crimping pieces.

As described above, in the crimping terminal of the first aspect of the present invention, the right side walls of the wire cramping section and the crimping conductive section are provided as one side wall, and the left side walls of the wire cramping section and the crimping conductive section are also provided as one side wall. Therefore, the side walls of the crimping conductive section are restricted by the side walls of the wire cramping section. Hence, when the wire is pushed in the crimping slots of the crimping conductive section, the crimping blade members are prevented from being opened outwardly, because the side walls forming the crimping blade members are restricted as described above. In the case where the wire is cramped, and at the same time the wire is pushed in the crimping slots, the side walls of the wire cramping section are bent inwardly when the wire is cramped. Therefore, even if the crimping blade members of the crimping conductive section tend to open outwardly as the wire is pushed in the crimping slots, the crimping blade members are prevented from being opened outwardly, because the inward force acting on the side walls of the wire cramping section and the outward force acting on the side walls from the crimping blade members of the crimping conductive section are canceled out by each other.

In the crimping terminal of the second aspect of the present invention, as described above, the bottom wall, and the right and left walls of the crimping conductive section are coupled to the bottom wall and the right and left walls of the wire cramping section through the bottom wall and the right and left wall of the first coupling section. Hence, the wire cramping section and the crimping conductive section are high in mechanical strength, and the center of the wire cramping section and the center of the crimping conductive section are prevented from shifting from each other.

In the crimping terminal of the third aspect of the present invention, as described above, the right side walls of the electrical contact section, the crimping conductive section, and wire cramping section are provided as one side wall, and the left side walls of the electrical contact section, the crimping conductive section, and the wire cramping section are also provided as one side wall. Therefore, the side walls of the crimping conductive section are restricted by the side walls of the electrical contact section and by the side walls of the wire cramping section. Accordingly, when the wire is pushed in the crimping slots of the crimping conductive section, the right and left crimping blade members are scarcely opened outwardly, because the side walls having the crimping blades are restricted as described above. Since the electrical contact section is in the form of a box, the force of restriction of the side walls forming the crimping blades is considerably great, which positively prevents the crimping blades from being opened outwardly. This feature enhances the effects or merits of the crimping terminal of the first aspect or the second aspect of the present invention.

The crimping terminal of the fourth aspect of the present invention has the following effects or merits in addition to those of the crimping terminal of the third aspect of the present invention:

In the crimping terminal of the fourth aspect of the present invention, the crimping conductive section is coupled to the electrical contact section are coupled to each other through the second coupling section. In addition, in the wire cramping section, the crimping conductive section, and the electrical contact section, their bottom walls are provided as one wall, and their right side walls are provided as one wall, and their left side walls are also provided as one wall. Hence, the crimping terminal is high in rigidity as a whole, and the center of the wire cramping section and the center of the crimping conductive section are prevented from shifting from each other.

The crimping germinal of the fifth aspect of the present invention has the following effects or merits in addition to those of any one of first through fourth aspect of the present invention.

In the crimping terminal of the fifth aspect of the present invention, as described above, the front and rear crimping blades are provided, and the upper end portions of the right and left crimping blade members of each of the front and rear crimping blades are coupled through a coupling wall.

That is, the right crimping blade members are provided as one unit, and the left crimping blade members are also provided as one unit, which positively prevents the crimping blade members with the front and rear crimping blades from falling down.

The crimping terminal of the sixth aspect of the present invention has the following effect or merit in addition to that of the crimping terminal of the fifth aspect:

In the crimping terminal of the sixth aspect of the present invention, as described above, the coupling walls are the side walls of the crimping conductive section. Therefore, the effect of the side wall which prevents the crimping blade members from falling down is applied to the crimping blade members with the two crimping blades.

The crimping terminal of the seventh aspect of the present invention has the following effect or merit in addition to that of the crimping terminal of the sixth aspect of the present invention:

In the crimping terminal of the seventh aspect of the present invention, the first openings are formed in the right and left side walls of the crimping conductive section, respectively, and the protrusions extended from the front and rear edges of each of the first openings are bent inwardly to readily form the crimping blades whose upper end portions are coupled to each other through the coupling wall.

The crimping terminal of the eighth aspect of the present invention has the following effect or merit in addition to that of the crimping terminal of the seventh aspect of the present invention:

In the crimping terminal of the eight aspect of the present invention, owing to the formation of the first and second openings, at least three crimping pieces are arranged in the front-to-rear direction. In addition, all the crimping pieces are made continuous to one another by the side walls. This feature prevents the crimping blades of the crimping pieces from opening outwardly, and improves the reliability of the crimping terminal in electrical connection.

While there has been described in connection with the preferred embodiments of the invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A contact terminal comprising:

an electrical contact section for engaging with a mating terminal;

a wire cramping section being U-shaped in section, having a bottom wall and a pair of right and left side walls bent inwardly to fixedly hold an insulating sheath of a wire from above; and an electrically conductive section disposed between said electrical contact section and said wire cramping section for electrically connecting to a conductor of said wire, said electrically conductive section being U-shaped in section, having a bottom wall, a right side wall having a right insulation piercing blade member and a left side wall having a left insulation piercing blade member so as to define a slot between said right and left insulation piercing blade members, wherein said right side walls of said wire cramping section and said electrically conductive section are integrally provided as one flat right side wall, and said left side walls of said wire cramping section and said electrically conductive section are integrally provided as one flat left side wall, said right and left side walls each having a portion thereof being flat over the entire length of the side wall, and wherein a portion of each said right and left side walls of said electrically conductive section is partially cut and pressed inwardly so as to form said right and left insulation piercing blade members.

2. A contact terminal as claimed in claim 1, further comprising:

a first coupling section for coupling said electrically conductive section to said wire cramping section, said first coupling section being U-shaped in section, having a bottom wall, a right side wall and a left side wall, wherein said bottom wall, said right side wall and said left side walls of said electrically conductive section are coupled to said bottom wall, said right side wall and said left side wall of said wire cramping section through said bottom wall, said right side wall and said left side wall of said first coupling section, respectively.

3. A contact terminal as claimed in claim 1, in which said electrical contact section is made in the form of a box, having a right side wall, a left side wall, a top wall, and a bottom wall, and said right side walls of said electrical contact section and said electrically conductive section are integrally provided as one flat right side wall, and the left side walls of said electrical contact section and said electrically conductive section are integrally provided as one flat left side wall, wherein said right side walls of said electrical contact section, said electrically conductive section and said wire cramping section are formed into one continuous, flat right side wall and said left side walls of said electrical contact section, said electrically conductive section and said wire cramping section are formed into one continuous, flat left side wall, so that said continuous flat right side wall and said continuous flat left side wall are parallel to each other along their predetermined length.

4. A contact terminal as claimed in claim 2, in which said electrical contact section is made in the form of a box, having a right side wall, a left side wall, a top wall, and a bottom wall, and said right side walls of said electrical contact section and said electrically conductive section are integrally provided as one flat right side wall, and the left side walls of said electrical contact section and said electrically conductive section are integrally provided as one flat right side wall, wherein said right side walls of said electrical contact section, said electrically conductive section and said wire cramping section are formed into one continuous flat right side wall and said left side walls of said electrical contact section, said electrically conductive section and said wire cramping section are formed into one continuous flat left side wall, so that said continuous flat right side wall and said continuous flat left side wall are parallel to each other along their predetermined length.

5. A contact terminal as claimed in claim 3, further comprising:

a second coupling section for coupling said electrical contact section to said electrically conductive section, said second coupling section being U-shaped in section, having a bottom wall, a right side wall and a left side wall, wherein said bottom wall, said right side wall and said left side wall of said electrically conductive section are coupled to said bottom wall, said right side wall and said left side wall of said electrical contact section through said bottom wall, said right side wall and said left side wall of said second coupling section, respectively, so that said right side wall and said left side wall of said second coupling section form a portion of said continuous flat right side wall and said continuous flat left side wall, respectively.

6. A contact terminal as claimed in claim 4, further comprising:

a second coupling section for coupling said electrical contact section to said electrically conductive section, said second coupling section being U-shaped in section, having a bottom wall, a right side wall and a left side wall, wherein said bottom wall, said right side wall and said left side wall of said electrically conductive section are coupled to said bottom wall, said right side wall and said left side wall of said electrical contact section through said bottom wall, said right side wall and said left side wall of said second coupling section, respectively, so that said right side wall and said left side wall of said second coupling section form a portion of said continuous flat right side wall and said continuous flat left side wall, respectively.

7. A contact terminal as claimed in claim 1, in which each of said right and left insulation piercing blade members comprises a front and rear insulation piercing blades so as to define a front slot and a rear slot between said right and left insulation piercing blade members;

the upper end portions of said front and rear insulation piercing blades of said right insulation piercing blade members are coupled through a right coupling wall; and the upper end portions of said front and rear insulation piercing blades of said left insulation piercing blade members are coupled through a left coupling wall.

8. A contact terminal as claimed in claim 2, in which each of said right and left insulation piercing blade members comprises a front and rear insulation piercing blades so as to define a front slot and a rear slot between said right and left insulation piercing blade members;

the upper end portions of said front and rear insulation piercing blades of said right insulation piercing blade members are coupled through a right coupling wall; and the upper end portions of said front and rear insulation piercing blades of said left insulation piercing blade members are coupled through a left coupling wall.

9. A contact terminal as claimed in claim 3, in which each of said right and left insulation piercing blade members comprises a front and rear insulation piercing blades so as to define a front slot and a rear slot between said right and left insulation piercing blade members;

the upper end portions of said front and rear insulation piercing blades of said right insulation piercing blade members are coupled through a right coupling wall; and the upper end portions of said front and rear insulation piercing blades of said left insulation piercing blade members are coupled through a left coupling wall.

10. A contact terminal as claimed in claim 4, in which each of said right and left insulation piercing blade members comprises a front and rear insulation piercing blades so as to define a front insulation piercing slot and a rear slot between said right and left insulation piercing blade members;

the upper end portions of said front and rear insulation piercing blades of said right insulation piercing blade members are coupled through a right coupling wall; and the upper end portions of said front and rear insulation piercing blades of said left insulation piercing blade members are coupled through a left coupling wall.

11. A contact terminal as claimed in claim 5, in which each of said right and left insulation piercing blade members comprises a front and rear insulation piercing blades so as to define a front slot and a rear slot between said right and left insulation piercing blade members;

the upper end portions of said front and rear insulation piercing blades of said right insulation piercing blade members are coupled through a right coupling wall; and the upper end portions of said front and rear insulation piercing blades of said left insulation piercing blade members are coupled through a left coupling wall.

12. A contact terminal as claimed in claim 6, in which each of said right and left insulation piercing blade members comprises a front and rear insulation piercing blades so as to define a front slot and a rear slot between said right and left insulation piercing blade members;

the upper end portions of said front and rear insulation piercing blades of said right insulation piercing blade members are coupled through a right coupling wall; and the upper end portions of said front and rear insulation piercing blades of said left insulation piercing blade members are coupled through a left coupling wall.

13. A contact terminal as claimed in claim 7, in which said right coupling wall is formed by a part of said right side walls of said electrically conductive section, and said left coupling wall is formed by a part of said left side walls of said electrically conductive section.

14. A contact terminal as claimed in claim 8, in which said right coupling wall is formed by a part of said right side walls of said electrically conductive section, and said left coupling wall is formed by a part of said left side walls of said electrically conductive section.

15. A contact terminal as claimed in claim 9, in which said right coupling wall is formed by a part of said right side walls of said electrically conductive section, and said left coupling wall is formed by a part of said left side walls of said electrically conductive section.

16. A contact terminal as claimed in claim 10, in which said right coupling wall is formed by a part of said right side walls of said electrically conductive section, and said left coupling wall is formed by a part of said left side walls of said electrically conductive section.

17. A contact terminal as claimed in claim 11, in which said right coupling wall is formed by a part of said right side walls of said electrically conductive section, and said left coupling wall is formed by a part of said left side walls of said electrically conductive section.

18. A contact terminal as claimed in claim 12, in which said right coupling wall is formed by a part of said right side walls of said electrically conductive section, and said left coupling wall is formed by a part of said left side walls of said electrically conductive section.

19. A contact terminal as claimed in claim 13, in which said front and rear insulation piercing blades of said right insulation piercing blade members are respectively made by bending protrusions extended from front and rear edges of a first opening formed on said right side wall of said electrically conductive section, and said right coupling wall are made by a wall-like portion remaining above said first opening; and said front and rear insulation piercing blades of said left insulation piercing blade members are respectively made by bending protrusions extended from front and rear edges of a first opening formed on said left side wall of said electrically conductive section, and said left coupling wall are made by a wall-like portion remaining above said first opening.

20. A contact terminal as claimed in claim 14, in which said front and rear insulation piercing blades of said right insulation piercing blade members are respectively made by bending protrusions extended from front and rear edges of a first opening formed on said right side wall of said electrically conductive section, and said right coupling wall are made by a wall-like portion remaining above said first opening; and said front and rear insulation piercing blades of said left insulation piercing blade members are respectively made by bending protrusions extended from front and rear edges of a first opening formed on said left side wall of said electrically conductive section, and said left coupling wall are made by a wall-like portion remaining above said first opening.

21. A contact terminal as claimed in claim 15, in which said front and rear insulation piercing blades of said right insulation piercing blade members are respectively made by bending protrusions extended from front and rear edges of a first opening formed on said right side wall of said electrically conductive section, and said right coupling wall are made by a wall-like portion remaining above said first opening; and said front and rear insulation piercing blades of said left insulation piercing blade members are respectively made by bending protrusions extended from front and rear edges of a first opening formed on said left side wall of said electrically conductive section, and said left coupling wall are made by a wall-like portion remaining above said first opening.

22. A contact terminal as claimed in claim 16, in which said front and rear insulation piercing blades of said right insulation piercing blade members are respectively made by bending protrusions extended from front and rear edges of a first opening formed on said right side wall of said electrically conductive section, and said right coupling wall are made by a wall-like portion remaining above said first opening; and said front and rear insulation piercing blades of said left insulation piercing blade members are respectively made by bending protrusions extended from front and rear edges of a first opening formed on said left side wall of said electrically conductive section, and said left coupling wall are made by a wall-like portion remaining above said first opening.

23. A contact terminal as claimed in claim 17, in which said front and rear insulation piercing blades of said right insulation piercing blade members are respectively made by bending protrusions extended from front and rear edges of a first opening formed on said right side wall of said electrically conductive section, and said right coupling wall are made by a wall-like portion remaining above said first opening; and said front and rear insulation piercing blades of said left insulation piercing blade members are respectively made by bending protrusions extended from front and rear edges of a first opening formed on said left side wall of said electrically conductive section, and said left coupling wall are made by a wall-like portion remaining above said first opening.

24. A contact terminal as claimed in claim 18, in which said front and rear insulation piercing blades of said right insulation piercing blade members are respectively made by bending protrusions extended from front and rear edges of a first opening formed on said right side wall of said electrically conductive section, and said right coupling wall are made by a wall-like portion remaining above said first opening; and said front and rear insulation piercing blades of said left insulation piercing blade members are respectively made by bending protrusions extended from front and rear edges of a first opening formed on said left side wall of said electrically conductive section, and said left coupling wall are made by a wall-like portion remaining above said first opening.

25. A contact terminal as claimed in claim 19, in which the right and left side walls of said electrically conductive section have second openings in such a manner that said second openings are respectively in alignment with said first openings in a front-to-rear direction, and protrusions extended from the front or rear edges of said second openings are bent inwardly to form a pair of insulation piercing blades between which a third slot is defined.

26. A contact terminal as claimed in claim 20, in which the right and left side walls of said electrically conductive section have second openings in such a manner that said second openings are respectively in alignment with said first openings in a front-to-rear direction, and protrusions extended from the front or rear edges of said second openings are bent inwardly to form a pair of insulation piercing blades between which a third slot is defined.

27. A contact terminal as claimed in claim 21, in which the right and left side walls of said electrically conductive section have second openings in such a manner that said second openings are respectively in alignment with said first openings in a front-to-rear direction, and protrusions extended from the front or rear edges of said second openings are bent inwardly to form a pair of insulation piercing blades between which a third slot is defined.

28. A contact terminal as claimed in claim 22, in which the right and left side walls of said electrically conductive section have second openings in such a manner that said second openings are respectively in alignment with said first openings in a front-to-rear direction, and protrusions extended from the front or rear edges of said second openings are bent inwardly to form a pair of insulation piercing blades between which a third slot is defined.

29. A contact terminal as claimed in claim 23, in which the right and left side walls of said electrically conductive section have second openings in such a manner that said second openings are respectively in alignment with said first openings in a front-to-rear direction, and protrusions extended from the front or rear edges of said second openings are bent inwardly to form a pair of insulation piercing blades between which a third slot is defined.

30. A contact terminal as claimed in claim 24, in which the right and left side walls of said electrically conductive section have second openings in such a manner that said second openings are respectively in alignment with said first openings in a front-to-rear direction, and protrusions extended from the front or rear edges of said second openings are bent inwardly to form a pair of insulation piercing blades between which a third slot is defined.

* * * * *